US010065660B2

(12) United States Patent
Mosher

(10) Patent No.: US 10,065,660 B2
(45) Date of Patent: Sep. 4, 2018

(54) DUAL CABLE ZIPLINE TROLLEY TRANSFER SYSTEM

(71) Applicant: Andrew W. Mosher, Oak Bay (CA)

(72) Inventor: Andrew W. Mosher, Oak Bay (CA)

(73) Assignee: Andrew W. Mosher, New Brunswick (CA)

( * ) Notice: Subject to any disclaimer, the term of this patent is extended or adjusted under 35 U.S.C. 154(b) by 273 days.

(21) Appl. No.: 15/204,554

(22) Filed: Jul. 7, 2016

(65) Prior Publication Data

US 2018/0009449 A1 Jan. 11, 2018

(51) Int. Cl.

| | |
|---|---|
| ***B61B 7/00*** | (2006.01) |
| ***B61B 7/04*** | (2006.01) |
| ***B61B 12/00*** | (2006.01) |
| ***A63G 21/20*** | (2006.01) |

(52) U.S. Cl.

CPC ..... *B61B 12/00* (2013.01); *A63G 21/20* (2013.01); *B61B 7/00* (2013.01); *B61B 7/04* (2013.01)

(58) Field of Classification Search

CPC .... B61B 7/00; B61B 7/02; B61B 7/04; B61B 7/045; B61B 12/00; A63G 21/20; A63G 21/22

See application file for complete search history.

(56) References Cited

U.S. PATENT DOCUMENTS

| | | | | |
|---|---|---|---|---|
| 4,641,587 A * | 2/1987 | Dalliard | B61B 7/06 | 104/112 |
| 5,465,668 A * | 11/1995 | Tarassoff | B61B 7/02 | 104/112 |
| 2004/0050286 A1* | 3/2004 | Liodden | B61B 7/02 | 105/148 |
| 2011/0022252 A1* | 1/2011 | Dueck | B61B 1/00 | 701/19 |

* cited by examiner

*Primary Examiner* — Ryan A Reis

(57) ABSTRACT

This invention is a gravity powered Dual Cable Zipline Trolley Transfer System comprising, a dual cable zipline trolley and dual cable zipline transfer unit which work in conjunction of each other. The trolley comprises tandem wheels that traverse over the dual cables and are pivoted in the center to allow the trolley to pass smoothly over the transfer unit, which is suspended on support structures. Unlike the traditional zipline which has a path between two stations, this system is designed to allow the participant to travel in a continuous uninterrupted path without the need to detach from one cable to another in order to sustain the journey beyond the station. The transfer unit is lengthened to create curves both horizontal and vertical. This invention eliminates the menacing sag in the cable that occurs over distance.

20 Claims, 5 Drawing Sheets

DUAL CABLE ZIPLINE TROLLEY TRANSFER SYSTEM

FIELD OF INVENTION

This Invention relates to a Dual Cable Zipline System.

BACKGROUND OF THE INVENTION

A zipline (or zip line, zip wire, aerial runway) is generally comprised of a trolley suspended on a cable, typically single and made of steel, attached between two platforms at a set distance apart. Usually erected at an elevated height and mounted on an incline. A zipline is designed to enable a participant propelled by gravity to travel in a straight forward path from one platform to another, while holding onto, or attached by a lanyard, to a freely moving trolley.

Some of the problems with the traditional zipline:

The traditional zipline acquires sag in the cable resultant from being erected over long distance. The further the cable is anchored between each platform, the greater the sag in the cable.

The conventional zipline is restricted to traverse in a straight forward path from Point A to Point B and does not allow the rider on the cable to continue beyond Point B or travel in a different direction, unless the rider is detached from one cable and attached to another.

The conventional zipline does not allow for curves, vertical or horizontal.

The traditional zipline is commonly erected high above the canopy and generally does not cater to the elderly, handicapped or participants who have a fear of heights.

SUMMARY OF THE INVENTION

This invention provides, in its broadest concept, improvements in the traditional zipline.

This invention is a gravity or motor powered Dual Cable Zipline Trolley Transfer System, comprised of a Dual Cable Zipline Trolley and Dual Cable Zipline Transfer Unit which work in conjunction of each other.

An entity of one aspect of the invention allows the participant on the trolley to traverse uninterrupted on a continuous path from Point A to Point B to Point C and so on, without the need to detach from one cable and attach to another.

An entity of another aspect of this invention allows for different directions without changing to another cable An entity of yet a further aspect of this invention provides an unlimited series of patterns including straight, curves; horizontal or vertical, roller coaster motion and/or circles.

An entity of an additional aspect of this invention contributes to a lower height, but not restricted to, to provide an enjoyable ride for everyone including the youth, the elderly, the handicapped, and/or participants who have a fear of heights.

An entity of still another aspect of this invention enables the participant to travel uninterrupted without needing to reduce or alter their speed.

Another entity of an aspect of this invention is a single wheel can be added perpendicularly on each side of the top of the trolley as a set of power wheels for forward or reverse travel.

DETAILED DESCRIPTION OF THE PREFERRED EMBODIMENT

Figure 1:
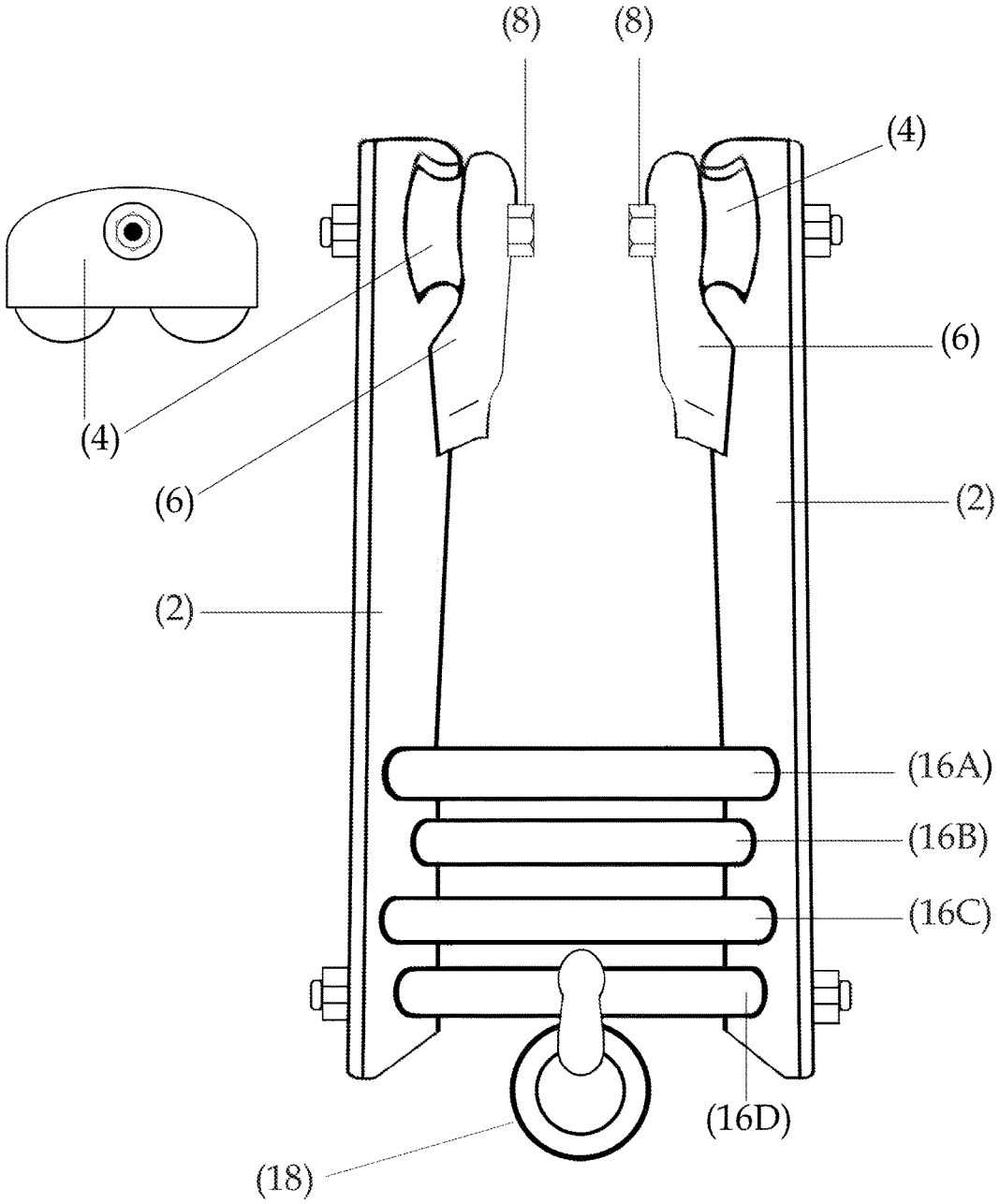
FIG. 1 is a frontal view of the Dual Cable Zipline Trolley and a sketch of the tandem wheels that have axles and bearings.
Figure 2:
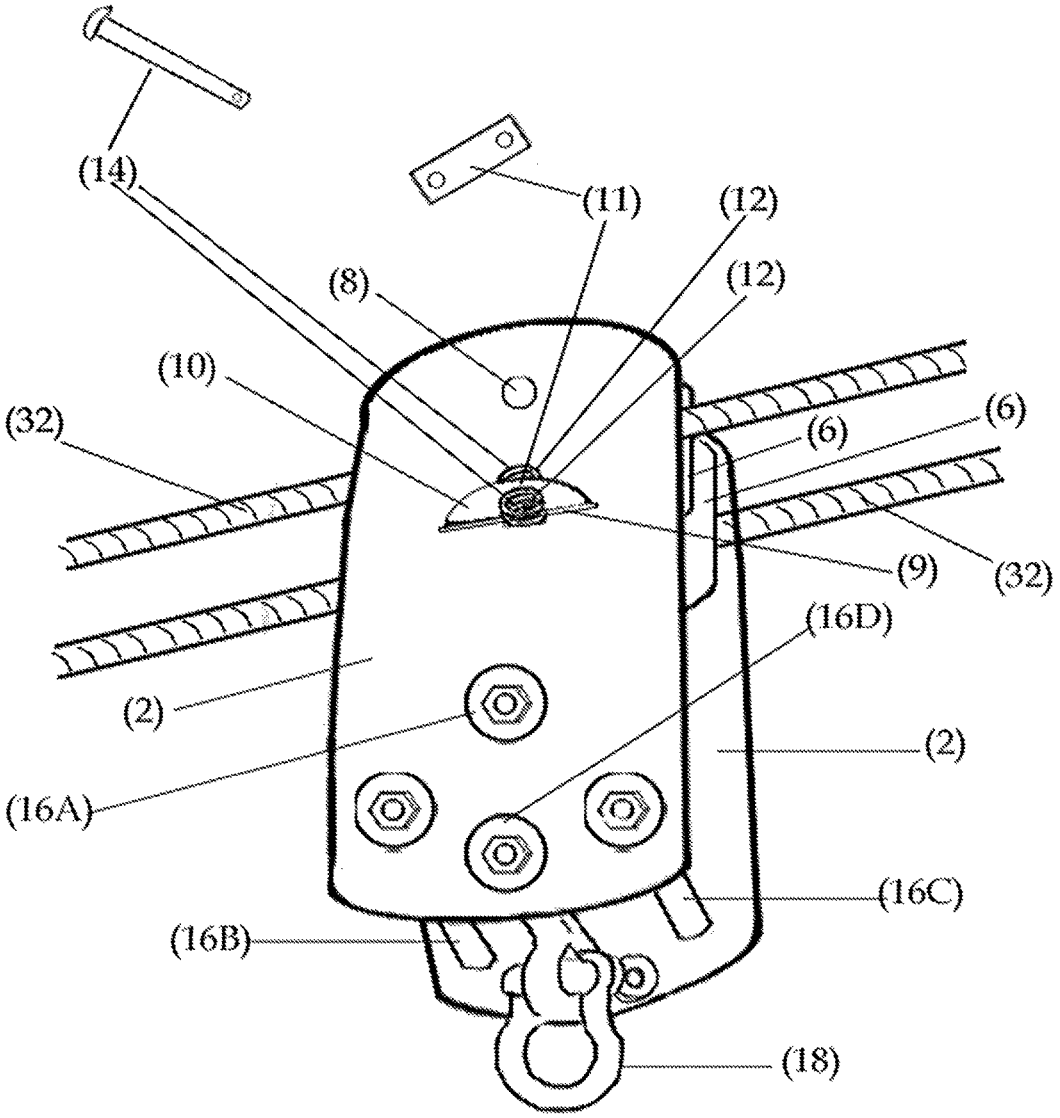
FIG. 2 is a side view of the Dual Cable Zipline Trolley. Included is a sketch showing a steel holder pin (14) that runs through the coil springs and a drawing of the short axle (11) used in this invention.
Figure 3:
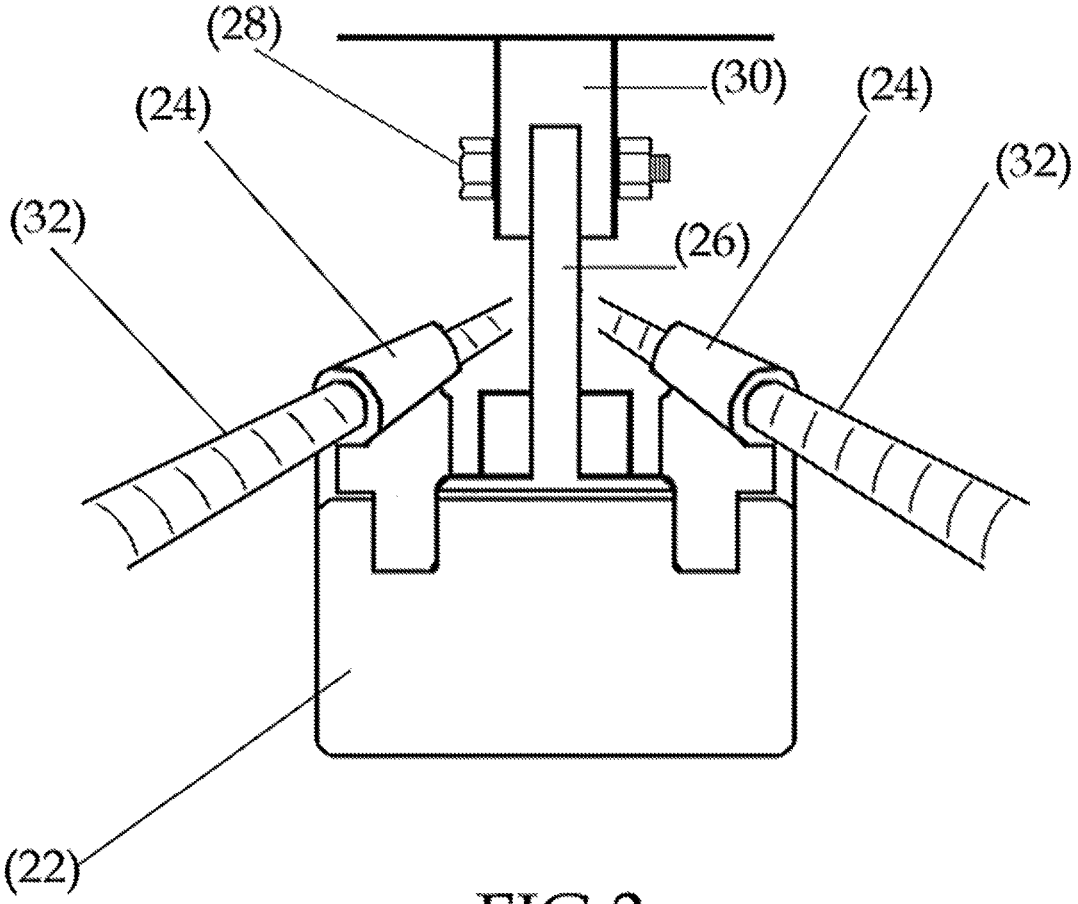
FIG. 3 is a frontal view of the Dual Cable Zipline Transfer Unit.
Figure 4:
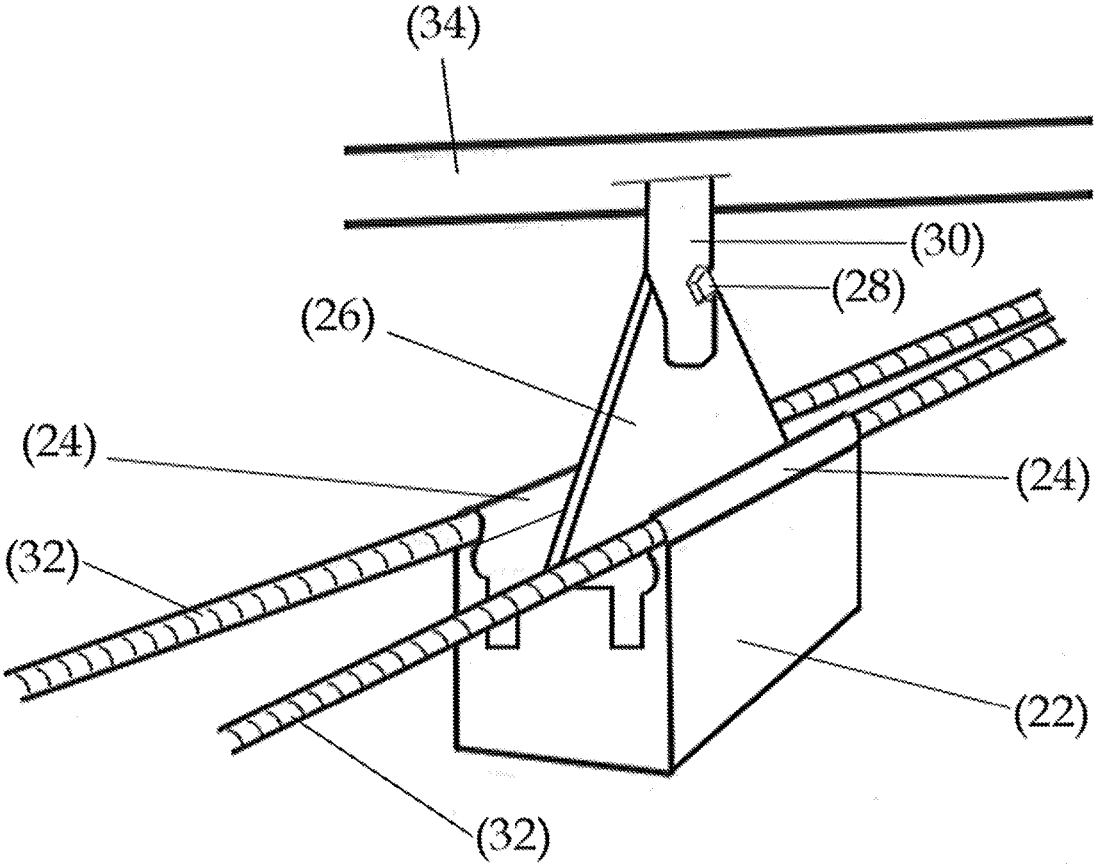
FIG. 4 is a side view of the Dual Cable Zipline Transfer Unit attached to the structure.
Figure 5:
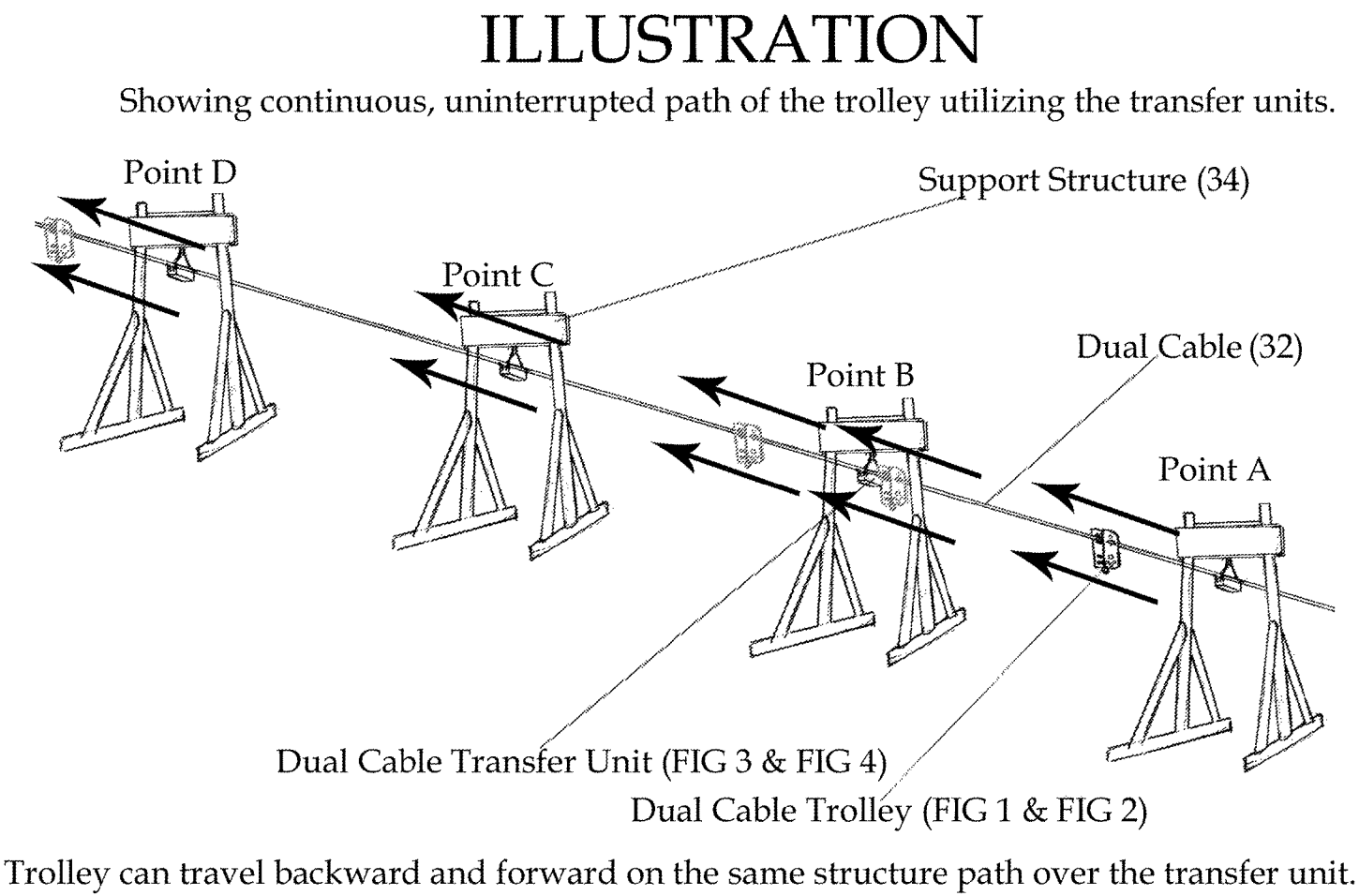
FIG. 5 shows the path of the Dual Cable Zipline Trolley propelling by gravity over the cable and over the Dual Cable Zipline Transfer Units, attached to structures along the path.

The preferred embodiment, a Dual Cable Zipline Trolley Transfer System, comprised of a Dual Cable Zipline Trolley identified by FIG. 1 & FIG. 2 and a Dual Cable Zipline Transfer Unit, identified by FIGS. 3 & 4 and form a system. The trolley (FIGS. 1 & 2) was strategically constructed to work with the transfer unit (FIG. 3 & FIG. 4).

The dual cable zipline trolley (FIG. 1 & FIG. 2) comprises, two steel outer plates (2), perpendicularly placed at a set distance apart; creating the main body that holds the components of the trolley. There are two sets of tandem zipline trolley wheels (4), connected with a steel pivot pin (8), which equalizes the tandem wheels (4) when entering the transfer unit, and are attached to the top of the trolley between the two steel outer plates (2). The tandem wheels (4) are fabricated from steel and have roller bearings and axles. Short inner flanges (6) are connected perpendicularly to the inner side of the tandem wheels (4) on each upper side of the trolley and serve to guide the wheels on the cable as the trolley traverses over the dual cables (32). The short inner flanges (6) also serve as a plate to secure the tandem wheels (4) in place. Steel pivot pins (8) are perpendicularly affixed to the top of the trolley on each side, and are attached in the center between the two sets of tandem trolley wheels (4); and serve to equalize the weight of each wheel as it makes the transition over the dual cable transfer unit. Two steel discs (10), which serve as a safety feature to prevent the trolley from lifting from the dual cables (32) protrude through the horizontal slot (9) on the steel outer plates of the trolley, and are perpendicularly affixed with a short axle (11). Two steel holder pins are perpendicularly attached to the outer steel plates of the trolley on each side and run through the orifices of the short axle(11), and run through the center of the coil springs (12), which are capped and locked to secure them in place, and allow the coil springs (12) to work independently of each other.

DETAILED DESCRIPTION OF THE PREFERRED EMBODIMENT

Four large steel shafts (16 A, 16 B, 16C, 16D) run horizontally through the steel outer plates (2) of the trolley and secure the bottom portion of the trolley at a fixed width. A hook-up clevis (18) is attached to the bottom of the trolley, in which is attached a seat.

The dual cable transfer unit (FIG. 3 & FIG. 4) is comprised of a rectangular steel box (22) opened at the top. Two steel tubes (24) affixed perpendicularly at a precise distance apart, to the outer top edges of the rectangular steel box (22) on each side allow the dual cables (32) to pass through, and also stabilize the dual cables (32) holding them firmly in place. A flat triangular steel plate (26) is connected to the inside center of the rectangular steel box (22) also attached to the inner both ends of the rectangular box (22). The flat triangular steel plate (26) keeps the transfer unit level, and keeps the dual steel cables (32) straight. A heavy steel pivot pin (28) connects the heavy steel shaft (30) to the flat triangular steel plate (26) through the orifice of the heavy steel shaft (30), and allows the transfer unit to pivot at the heavy steel shaft (30), and to accommodate for weight as the trolley enters the steel tubes (24) of the transfer unit. The heavy steel shaft (30) protrudes downward from the top of the support structure (34), and holds the dual cable transfer unit in place, and the heavy steel shaft (30) is capped and locked.

Support structures (34) are erected at a determined distance apart and each one holds a transfer unit (FIGS. 2 & 3) which is secured in place by the heavy steel shaft (30). Additional flat triangular steel plates (26) will be utilized when lengthening the transfer unit for the purpose of creating curves. Each flat triangular steel plate (26) is supported by an additional heavy steel shaft (30) when lengthening the transfer unit (FIG. 3& 4) for curves. This system includes dual steel cables (32) that are perpendicularly placed and, pass through the steel tubes (24) which are fastened horizontally, to the transfer unit at a precise distance apart. This invention is a gravity or motor powered system with the potential to append a caliper braking system.

What is claimed is:

1. A zipline system with reduced sag, comprising;

a) two parallel cables extending along a zipline path;

b) a plurality of spaced-apart support structures mounted along said zipline path and supporting said parallel cables in spans above a ground surface; each of said support structures comprising a cable transfer unit suspended thereto and supporting said parallel cables to said support structures with a lateral spacing between said cables;

c) each of said cable transfer units having an elongated body with a longitudinal dimension extending along said zipline path; said elongated body having an inverted T-shaped cross-section and a nominal overall width; said elongated body having two spaced apart tubes extending along said longitudinal dimension at said lateral spacing, each of said tubes enclosing one of said parallel cables therein; each of said tubes being affixed to said elongated body along a bottom surface thereof and having an exposed top surface; and d) a trolley having spaced-apart parallel side plates, support wheels mounted to inside surfaces of said side plates, and a clevis attached to said side plates; said support wheels being laterally spaced apart said lateral spacing; said support wheels being rolling along said zipline path on upper surfaces of said parallel cables and on said exposed top surfaces of said tubes; said trolley having a U-shaped cross-section with a central opening and said side plates being laterally spaced apart a distance greater than said nominal overall width of said cable transfer units; each of said cable transfer units passing through said central opening of said trolley when said support wheels of said trolley being rolled over said exposed top surfaces of said tubes.

2. The zipline system as claimed in claim 1, wherein said side plates of said trolley also comprises flanges enclosing said cables below said support wheels.

3. The zipline system as claimed in claim 1, wherein said support wheels on said trolley comprises two support wheels on each of said side plates of said trolley.

4. The zipline system as claimed in claim 3, wherein said two support wheels being mounted in a tandem-wheel arrangement supported on a single axle extending from each of said side plates.

5. The zipline system as claimed in claim 1, wherein said trolley also comprises a drive wheel mounted thereto above said support wheels and a motor connected to said drive wheel for driving said trolley along said zipline path.

6. The zipline system as claimed in claim 5, wherein said motor has a forward and reverse direction.

7. The zipline system as claimed in claim 1, wherein said elongated body of one of said cable transfer units has a curvature therein along said longitudinal axis thereof.

8. The zipline system as claimed in claim 4, wherein each of said cable transfer units being suspended to a pivot mounted to a respective one of said support structures; each of said transfer units being free to move as a pendulum about said pivot in a plane extending along said zipline path.

9. The zipline system as claimed in claim 1, wherein first horizontal alignment of said parallel cables between a first and second support structures is different than a second horizontal alignment of said parallel cables between said second and a third support structures.

10. The zipline system as claimed in claim 1, wherein a first vertical alignment of said parallel cables between a first and second support structures is different than a second vertical alignment between said second and a third support structures.

11. The zipline system as claimed in claim 7, wherein a first horizontal and vertical alignments of said parallel cables between a first and second support structures is different than a second horizontal and vertical alignments of said parallel cables between said second and a third support structures.

12. The zipline system as claimed in claim 7, wherein said zipline path has a zig-zag configuration.

13. The zipline system as claimed in claim 11, wherein said zipline path has an up and down roller-coaster configuration.

14. The zipline system as claimed in claim 7, wherein said zipline path has a circle configuration.

15. The zipline system as claimed in claim 1, wherein said zipline path has a closed circle and up and down configuration.

16. The zipline system as claimed in claim 1, wherein said trolley also comprises a braking system mounted thereto.

17. The zipline system as claimed in claim 1, wherein said trolley further comprises a disc mounted perpendicularly through each of said side plates below each of said wheels and below each of said cables.

18. The zipline system as claimed in claim 1, further comprising a seat suspended to said clevis.

19. The zipline system as claimed in claim 6, wherein first horizontal alignment of said parallel cables between a first and second support structures is different than a second horizontal alignment of said parallel cables between said second and a third support structures.

20. The zipline system as claimed in claim 6, wherein a first vertical alignment of said parallel cables between a first and second support structures is different than a second vertical alignment between said second and a third support structures.

* * * * *